US011404035B1

(12) United States Patent
Kuzma

(10) Patent No.: US 11,404,035 B1
(45) Date of Patent: Aug. 2, 2022

(54) AUTOMATED STRING PLAYER

(71) Applicant: Michael Stanley Kuzma, Peoria, IL (US)

(72) Inventor: Michael Stanley Kuzma, Peoria, IL (US)

( * ) Notice: Subject to any disclaimer, the term of this patent is extended or adjusted under 35 U.S.C. 154(b) by 0 days.

(21) Appl. No.: 17/233,494

(22) Filed: Apr. 18, 2021

(51) Int. Cl.

| | |
|---|---|
| ***G10F 1/00*** | (2006.01) |
| ***G10F 1/20*** | (2006.01) |
| ***G10D 3/00*** | (2020.01) |
| ***G10D 1/08*** | (2006.01) |
| ***G10F 5/00*** | (2006.01) |

(52) U.S. Cl.
CPC ..... *G10F 1/20* (2013.01); *G10D 1/08* (2013.01); *G10D 3/00* (2013.01); *G10F 5/00* (2013.01)

(58) Field of Classification Search
CPC ..... G10F 1/20; G10F 5/00; G10D 3/00
See application file for complete search history.

(56) References Cited

U.S. PATENT DOCUMENTS 1,018,384 A * 2/1912 Wauters ..... G10F 1/18 84/146
1,238,884 A * 9/1917 Cartmell ..... G10F 1/20 84/273
1,797,609 A * 3/1931 Hallbauer ..... G10F 1/20 984/211
1,871,021 A * 8/1932 Zachrison ..... G10F 1/20 984/211
4,615,253 A * 10/1986 McGovern ..... G10D 3/08 984/116
5,212,330 A * 5/1993 Cooper ..... G10D 3/173 84/320
5,393,925 A * 2/1995 Wilson ..... G10F 1/20 84/321
6,166,307 A * 12/2000 Caulkins ..... G10D 3/00 84/50
6,723,904 B1 * 4/2004 Dolan ..... G10D 3/00 84/290
7,285,709 B2 * 10/2007 White ..... G10D 3/08 84/320
7,285,716 B2 * 10/2007 Gilmore ..... G10F 1/20 84/727
7,812,233 B1 * 10/2010 Lee ..... G10H 1/20 84/646
8,492,627 B2 * 7/2013 DuPra ..... G10D 3/173 84/723
8,546,672 B1 * 10/2013 Pinzone ..... G10D 3/16 84/320
2005/0172779 A1 * 8/2005 Gilmore ..... G10F 1/20 84/8
2012/0103163 A1 * 5/2012 DuPra ..... G10D 3/173 84/9
2018/0088757 A1 * 3/2018 Suyama ..... H04M 1/72403

* cited by examiner

*Primary Examiner* — Robert W Horn

(57) ABSTRACT

Invention is an attachment to any stringed instrument with a neck and fretboard/fingerboard that enables the stringed instrument to play itself. The invention comprises of a picking system, a fretting system, and an interface that allows a user to select what music they would like to play on the stringed instrument. The picking and fretting systems are releasably attached to the stringed instrument. Permanent modifications to the stringed instrument are not required to install the automated string player attachments.

22 Claims, 7 Drawing Sheets

AUTOMATED STRING PLAYER

CROSS REFERENCE TO RELATED APPLICATION

This application claims priority to U.S. provisional 63/016,883 filed on Apr. 28, 2020.

BACKGROUND

The automated string player is an augmentation to any guitar and any stringed instrument with a neck and fretboard/fingerboard that allows the stringed instrument to play itself. Unlike a player piano that utilizes a dedicated hammer for each note, the automated string player utilizes a fretting system and picking system in combination with the fretboard/fingerboard of the stringed instrument to play multiphonic musical passages. Also unlike the player piano, the automated string player can be removed from the stringed instrument entirely. The automated string player technology will have many applications, including but not limited to a system that (1) enhances the ambiance of public/private environments, (2) allows for stand-alone shows or accompaniment in a performance setting, (3) enhances visualization of music for songwriters and those wishing to learn how to play the stringed instrument, and (4) enables people with disabilities to create/display music on a guitar or similar stringed instrument. This technology is an add-on to a stringed instrument and can be easily removed without altering the original stringed instrument. The technology is applicable to many stringed instruments with a fretboard/fingerboard (e.g. guitar, banjo, bass, violin, viola, cello, ukulele, mandolin, guitar, etc.).

SUMMARY OF THE INVENTION

The automated string player is an electro-mechanical augmentation automatically plays a guitar or similar stringed instrument. The automated string player selects what location to fret/press/touch along an instrument neck, mechanically frets or presses a string, and picks/plucks the string of a guitar or similar stringed instrument. This system is able to execute those same tasks on every string to play music. Each string employs a replicated subsystem to play a single string. The fretting subsystem is mounted to the neck or body of the stringed instrument. The fretting subsystem uses a rail, drive member, and fretting actuator to fret anywhere along the instrument neck. The picking subsystem is mounted to the stringed instrument with a clamp. The picking subsystem uses a picking actuator to pick/pluck a string. In total, each string will have electrical components such as a drive member, a fretting actuator, a picking actuator, and a sensor (for initialization) to play music on that string. The user of the device has the ability to select digitally stored music to play with an interface. Among other features, the user will also have the ability to play, pause, and skip songs. The user can directly control what music is being played for music ideation/songwriting. Permanent modifications to the stringed instrument are not required in order to install the automated string player attachments.

BRIEF DESCRIPTION OF THE DRAWINGS

FIG. 1 is a side profile of an example stringed instrument that the automated string player is designed to attach to.

FIG. 10 shows the interface and an example of what the interface may look like.

DETAILED DESCRIPTION OF THE INVENTION

Figure 2:
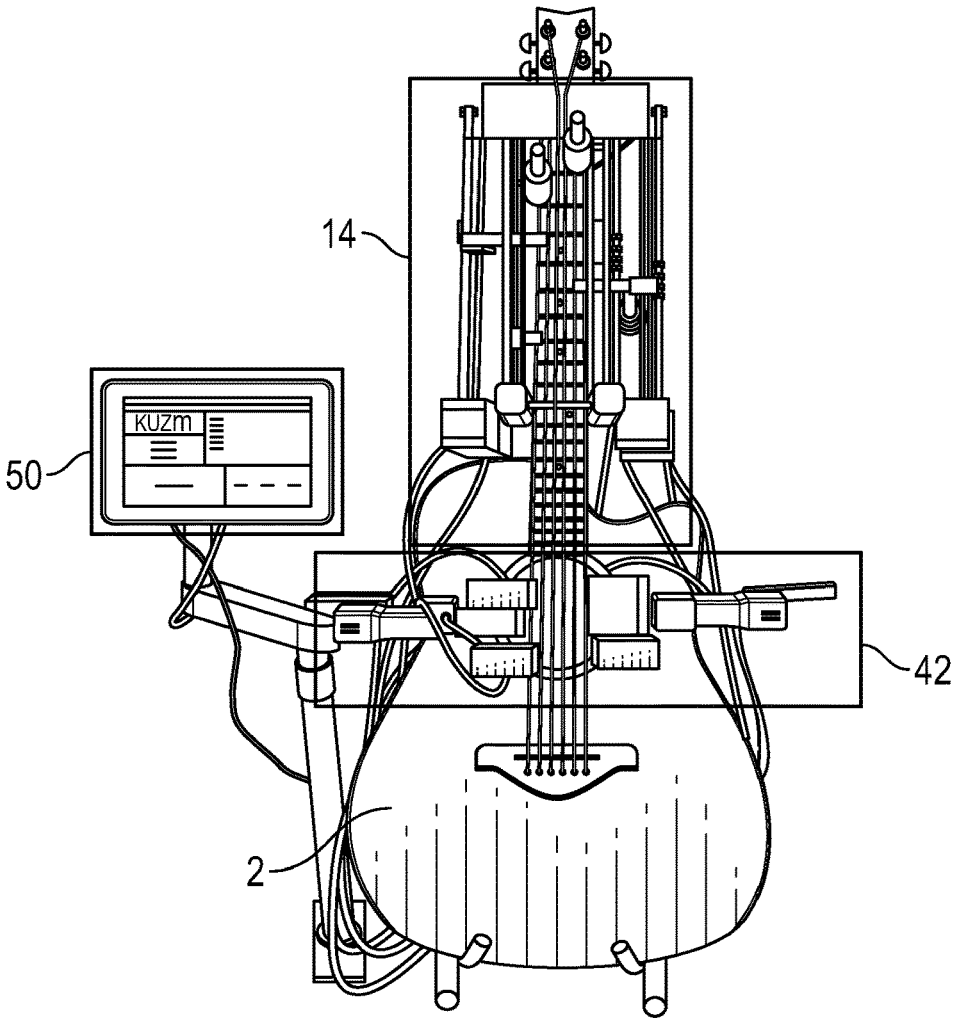
FIG. 2 is a view of an acoustic guitar with the automated string player attached thereto.
Figure 3:
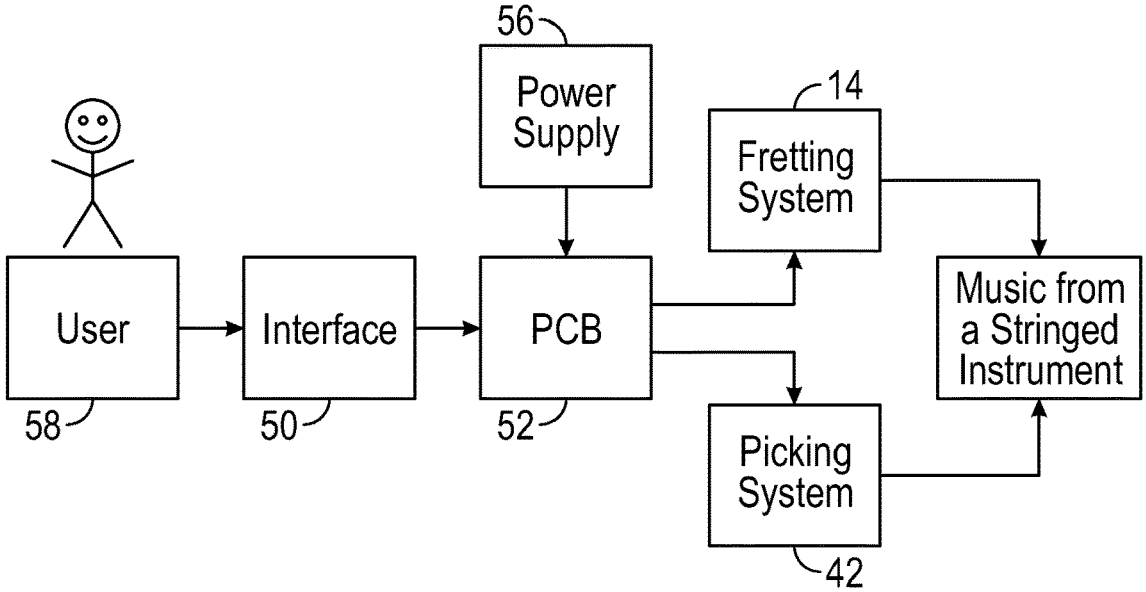
FIG. 3 is a view of the general block diagram for the system flow of the automated string player.

The automated string player, as shown in FIG. 2, is an electromechanical device designed to play a guitar or similar stringed instrument. In this description, the term instrument will always refer to the stringed instrument 2 in which the invention (automated string player) is attached to.

Figure 1:
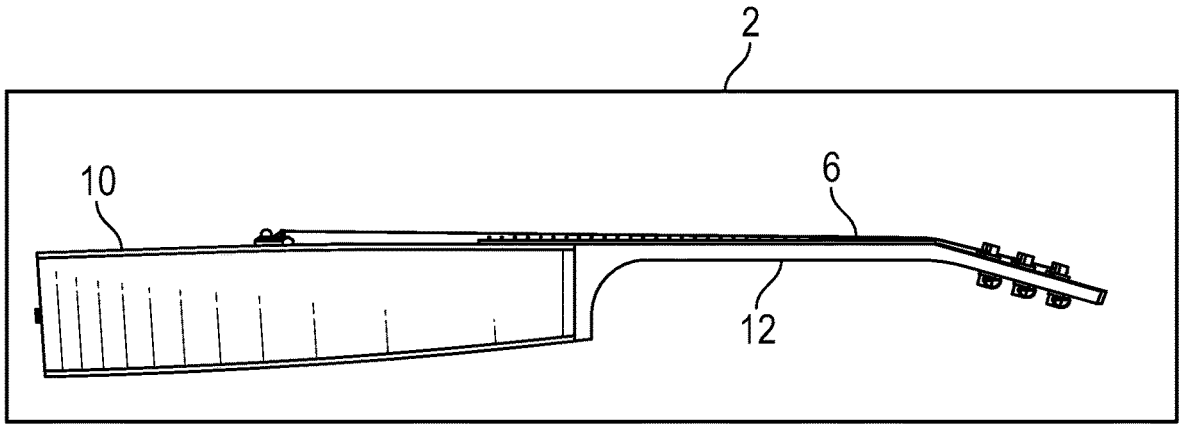

The invention is directed towards any stringed instrument 2 with a neck 12 and a fretboard/fingerboard 6; the stringed instrument 2 being a musical instrument that produces sound by the vibration of stretched strings 8; the neck 12 being the part of the stringed instrument 2 that projects from a main body 10 and is the base of the fretboard/fingerboard 6; the fretboard/fingerboard 6 being a flat or roughly flat portion on the neck 12, against which strings 8 may be pressed to shorten the vibrating length of the instrument 2 and produce notes of higher pitches. The following description will predominantly focus on guitars; however, this is not a restriction of the invention to guitars. The invention is equally applicable to all stringed instruments 2 with the neck 12 and fretboard/fingerboard 6, including, but not limited to: violin, viola, guitar (including bass guitar), banjo, bass, cello, ukulele, and mandolin. FIG. 1 displays an example of the type of instrument the invention can be attached to.

Permanent modifications to the instrument 2 are not required to install and uninstall the invention. The invention enables playing of the stringed instrument 2 without permanently changing the instrument 2. The invention can be removed to return the instrument 2 for manual performance. Permanent manipulation of the instrument 2 is defined as removal of material from the instrument 2 before, during, or after installation of the invention. Permanent manipulation also entails installation of the invention in a manner that is not releasably attached. Therefore, there are no glues or adhesives that are used to attach the invention to the instrument 2. There is also no drilling or cutting of the instrument 2 to attach the invention to the instrument 2.

The invention has an independent controllable system for every string 8 of the instrument 2. Each independent system can select a note on the fretboard/fingerboard 6, press or fret a string 8 against the fretboard/fingerboard 6, and/or pick/hit/touch a string 8 to create a musical note. With each string 8 not dependent on the other, music can be played on each string 8 of the instrument 2 independently.

The invention is comprised of a fretting system 14, picking system 42, and interface 50. The fretting system 14 is a culmination of components that enable at least one string 8 of the stringed instrument 2 to be fretted or pressed with electronic and/or mechanical components to change the musical pitch of the string 8. The picking system 42 is a culmination of components that enable at least one string 8 of the stringed instrument 2 to be plucked and/or achieve sound. The interface 50 is a culmination of components that provide the means for the user 58 of the invention and the invention to interact to play music as desired. FIG. 2 shows one embodiment of the invention with the picking system 42 and fretting system 14 attached to a 6-string acoustic guitar and an interface 50 near the instrument 2. The embodiment shown in FIG. 2 can play all strings 8 of the instrument 2.

The fretting system 14 can mimic many common and advanced musical stringed instrument 2 techniques, including but not limited to fretting, hammer-ons, tremolos, muting, harmonics, slides, bends, and pull-offs. For each string 8, the fretting system 14 is comprised of a drive member 22 that electrically propels a fretting actuator 32 mounted in an actuator carriage 30 to variable locations along the neck 12. The drive member 22 can be various types of electric motors. The drive member 22 is attached to a drive gear 26 placed on the shaft of the drive member 22. Tensioned between the drive gear 26 and a pulley 28 is a belt 24 that attaches to the actuator carriage 30 that provides the drive force to the actuator carriage 30. To guide the motion of the fretting actuator 32 in a constrained linear path, the actuator carriage 30 is attached to a rail 20. The rail 20 is mounted generally in parallel with the string 8 to be fretted/pressed/touched. The rail 20 is a linear guide in the single string 8 depiction of the fretting system 14 in FIG. 4, but in other embodiments of the fretting system 14, the rail 20 can be a rack for a rack and pinion design, and/or a lead screw used with a ball screw. The motion of the actuator carriage 30 is necessary to select what location along the fretboard/fingerboard 6 to press/fret/touch.

Figure 5:
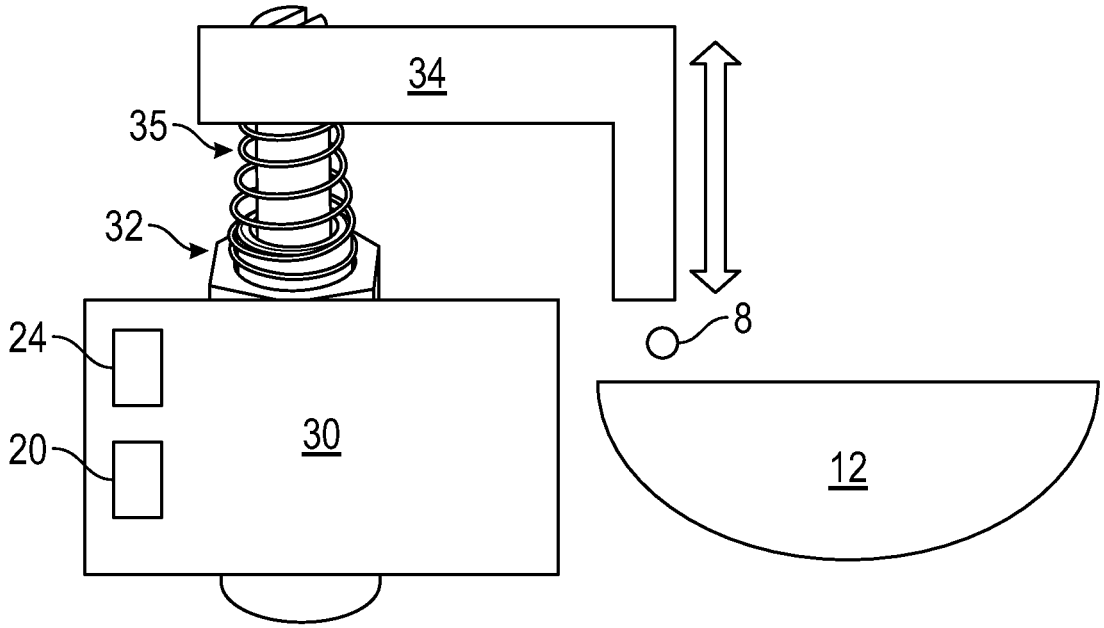
FIG. 5 shows the components of a fretting system responsible for fretting or pressing a string. The fretting grips, drive member, drive gear, and pulley are not present in this image.

In order to mechanically fret or press a string 8 on the fretboard/fingerboard 6, a fretting hammer 34 is attached to the plunger or shaft of the fretting actuator 32. When the fretting actuator 32 is electrically activated, the fretting hammer 34 is driven by the fretting actuator 32 towards the string 8 to touch, press, push, and/or fret the string 8. The fretting actuator 32 drive force can be manipulated by varying the electrical input into the fretting actuator 32. In the embodiment shown in FIG. 5, the fretting actuator 32 is electrically unidirectional; a spring 35 is installed on the plunger or shaft of the fretting actuator 32 to return the fretting hammer 34 away from the string 8 when electrical power is removed from the fretting actuator 32. In the embodiment as shown in FIG. 5, the fretting actuator 32 is a solenoid, but in other embodiments, the fretting actuator 32 is a voice coil and/or electric motor. If the instrument 2 has paired strings 8 such as in a 12-string guitar, the fretting system 14 will act on both strings 8 in the pair to fret/press/touch in the same manner as described above.

For each string 8 in the fretting system 14, software used to control the fretting system 14 must know the location of the actuator carriage 30 in relation to the fretboard/fingerboard 6. Software knowledge of the actuator carriage 30 is necessary to correctly select the location along the neck 12 to fret/press/touch while playing music. An initialization sequence is used to initialize the fretting system 14. To initialize the fretting system 14, the drive member 22 is given electric power to move the actuator carriage 30 until a sensor 40 is near the actuator carriage 30. When the sensor 40 is in close proximity to the actuator carriage 30, the location of the fretting actuator 32 along the fretboard/fingerboard 6 is saved in software. The initialization sequence can be called in software at any point during operation to reset and/or home the fretting system 14. As shown in the embodiment in FIG. 4, a magnet 38 is mounted to the actuator carriage 30 for a magnetic sensor 40 to detect. The sensor 40 detects the location of the actuator carriage 30. The sensor 40 is a hall sensor in the embodiment in FIG. 4, but in other embodiments, the sensor 40 can be a vision sensor and/or mechanical switch. The location of the actuator carriage 30 after initialization is known through precise actuations of the drive member 22 and/or through closed-loop feedback from an encoder attached to the drive member 22.

Figure 4:
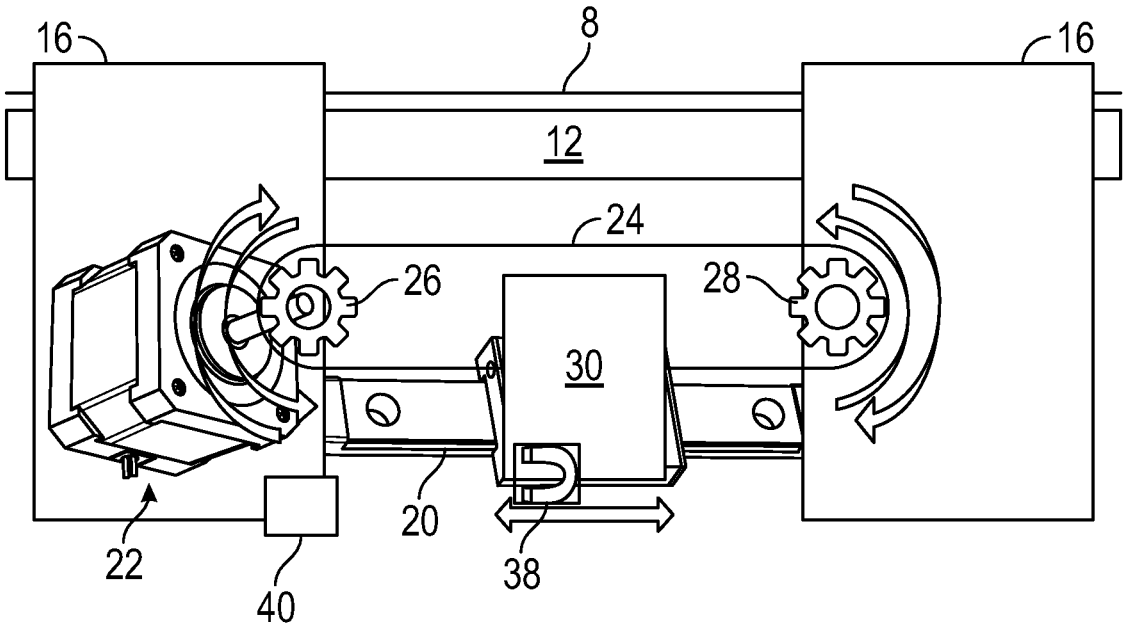
FIG. 4 shows the components of a fretting system responsible for selecting a fretting location on a single string. The fretting actuator and fretting hammer are not present in this image.

The fretting system 14 is connected to the instrument 2 by at least one fretting grip 16. The purpose of the fretting grips 16 is to provide a stationary point of attachment for the fretting system 14 to the instrument 2 in a releasably attached manner. Although not a requirement for the automated string player to function correctly, each fretting grip 16 has a moldable pad that adheres to the side of the neck 12 and/or body 10 when attached to the instrument. The moldable pad is desirable since attachment to the neck 12 with a rigid material could result in permanent abrasions on the instrument 2. On each fretting grip 16, there is at least one tab generally contacting the edge of the fretboard/fingerboard 6 of the neck 12 to keep the fretting system 14 level along the plane of the fretboard/fingerboard 6 when installed onto the instrument 2. The tab extends slightly past the moldable pad mounting point and sits along the string-side of the fretboard/fingerboard 6. The tab is small enough that it does not interfere with vibration of any string 8 on the instrument 2. In the embodiment shown in FIG. 6, fretting grips 16 mate together in pairs with at least one fastener 18; the fasteners 18 run perpendicular to the strings 8 across the neck 12 with one fastener 18 sitting on each side of the neck 12 for added rigidity; as the fasteners 18 are tightened, the moldable pad and tab of each fretting grip 16 are pushed against the neck 12 to form a strong releasably attached bond between the neck 12 and the fretting system 14. In the embodiment shown in FIG. 6, one pair of fretting grips 16 sit at the generally highest point along the neck 12 away from the body 10, while another pair of fretting grips 16 is attached to the generally lowest point along the neck 12 close to the body 10. Each rail 20 inserts into the fretting grips 16 to attach the fretting grip 16 pairs together, allowing for the fretting actuators 32 to move freely along the neck 12 when electrically controlled by the drive member 22. Although not required for functional operation of the fretting system 14, an embodiment of the invention has at least one support bar 17 inserted into the fret grips generally parallel with the strings 8 for additional rigidity. The support bars 17 connect between the fretting grips 16 in a similar manner that the rails 20 connect to the fretting grips 16. The drive members 22 and sensors 40 are attached to stationary locations on the fretting grips 16. In the embodiment where a belt drive is used as shown in FIG. 4, the pulley 28 is then mounted to freely spin at a stationary location on the fretting grips 16. The fretting system 14 can be removed from the instrument 2 by untightening and removing all fasteners 18.

Figure 6:
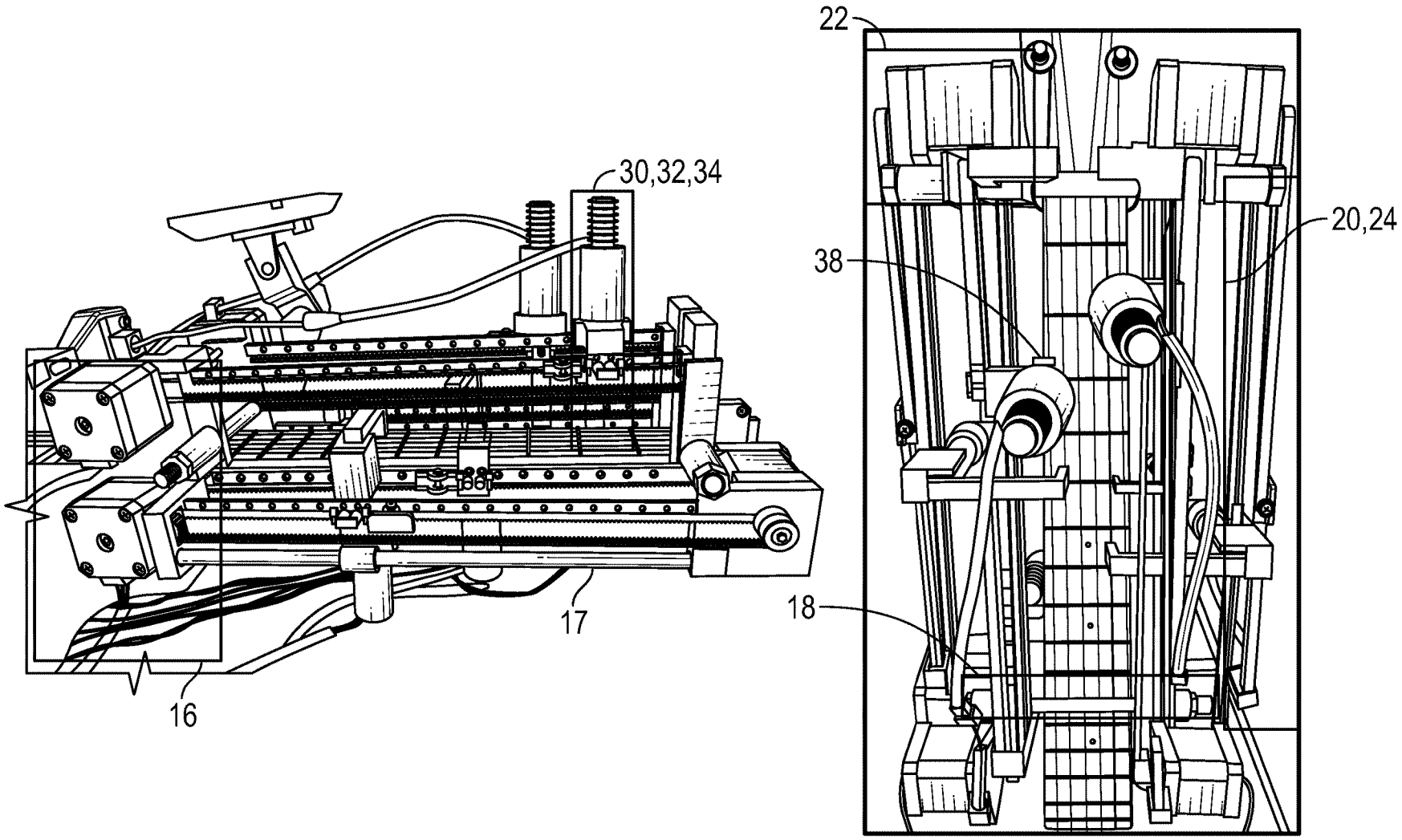
FIG. 6 shows the fretting system for 6 strings on a 6-string acoustic guitar.

Depending on the stringed instrument 2 and the amount of strings 8 on the instrument 2, there are many variations in the configuration of the fretting grips 16. In the most common embodiment as shown in FIG. 6, two pairs of fretting grips 16 are used. In another embodiment, a single fretting grip 16 pair is used with at least one fastener 18; one fretting grip 16, and at least one fastener 18 sit at the generally highest point along the neck 12 away from the body 10 while another fretting grip 16 and fastener 18 is attached to the generally lowest point along the neck 12 close to the body 10. In other embodiments on smaller instruments 2, a singular fretting grip 16 or singular pair of fretting grips 16 is used when additional rigidity is not necessary. The attachment points of the fretting grips 16 to the instrument 2 are not solely confined to the neck 12. The fretting grips 16 may also attach to the body 10.

Each actuator carriage 30, fretting actuator 32, and fretting hammer 34 for each string 8 is able to move freely generally parallel to the string 8 without running into any other actuator carriage 30, fretting actuator 32, and fretting hammer 34 also generally parallel to other strings 8 of the instrument 2. This functionality is achieved by placing the attachment locations of the rails to the fretting grips 16 all around the neck 12. Each fretting hammer 34 for every string 8 is able to move freely between a fretted, pressed, or touched position against the string 8 and an open position not touching the string 8, without interfering with the movement of any other fretting hammer 34 motion on separate strings 8. This functionality is achieved by shaping the fretting hammers 34 to not run into each other while playing music.

The fretting system 14 for each string 8 can be calibrated for alignment to the string 8. The connection points between the fretting grips 16 and the rails 20 may be manipulated with screws and captured threads to move the rail insertion hole into the fretting grips 16 slightly closer to the neck 12 or farther away from the neck 12 on a plane parallel to the strings 8. The manipulation of the insertion hole is to keep the rail 20 as generally parallel as possible to the length of the string 8. The calibration of the fretting system 14 enables the fretting system 14 to attach to many different styles of guitars and many other kinds of musical instruments 2 without having different versions of fretting grips 16.

If a faster fret selection speed is desired, additional and/or repeated fretting system 14 components may be applied to the same string 8. This would mean there would be an additional fretting actuator 32, actuator carriage 30, fretting hammer 34, drive member 22, drive gear 26, belt 24, pulley 28, and sensor 40 that are responsible for fretting a string 8. The additional fretting system 14 components would reduce travel speed necessary to move the fretting actuators 32 to the location on the fretboard/fingerboard 6 that is desired to play, allowing for consecutive notes on different fretting locations of the string to be played at a faster tempo. Additional fretting system 14 components can be placed on the same rail 20 of an existing fretting system 14 or on an additional rail 20.

Figure 7:
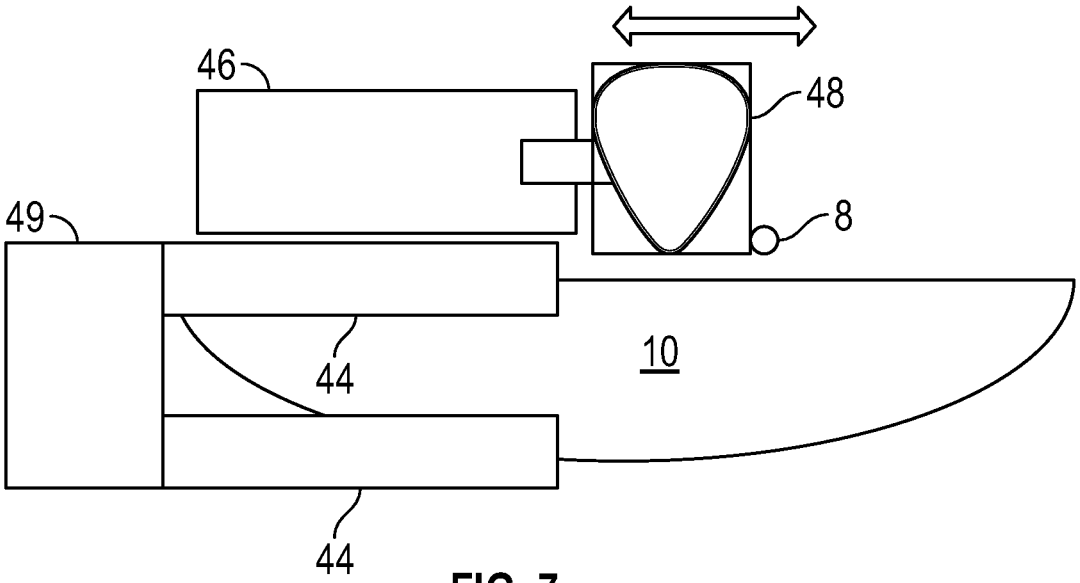
FIG. 7 shows the components for the picking system on a single string.
Figure 8:
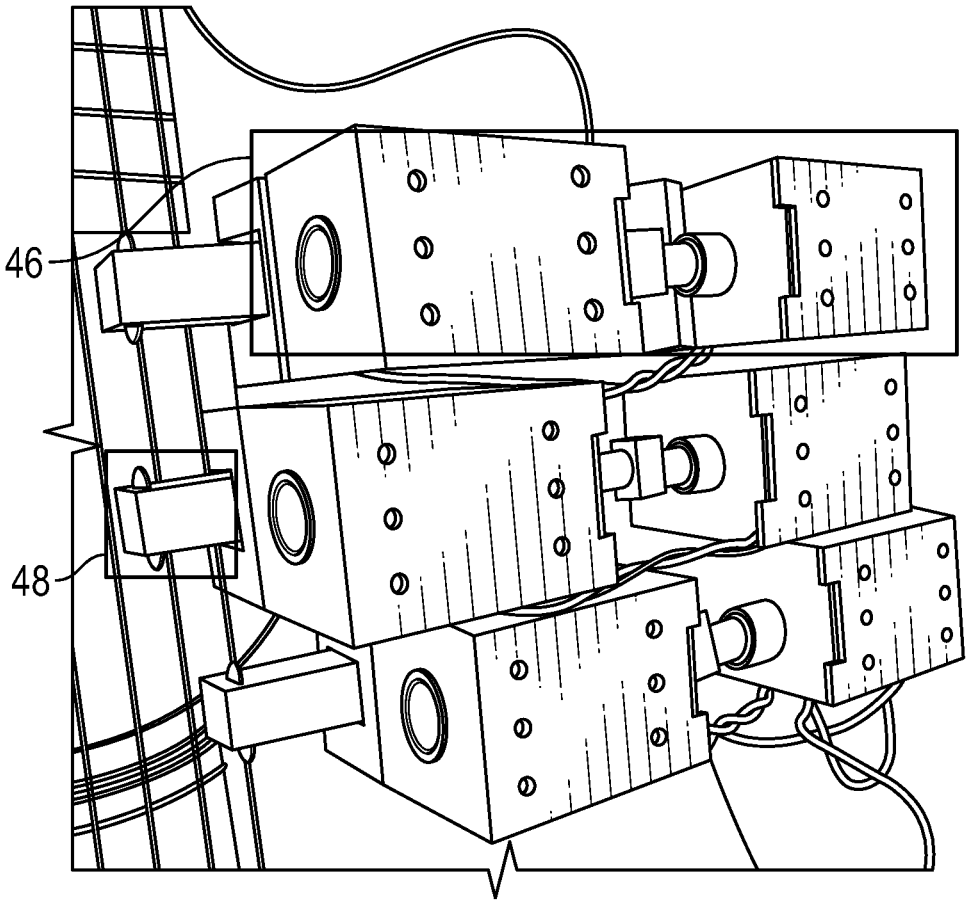
FIG. 8 shows an alternate embodiment of the picking system on 3 strings using solenoids with no end stop.

The picking system 42 utilizes a picking actuator 46 to pick/pluck/touch the string 8. The picking actuator 46 is mounted to a stationary position against at least one picking grip 44. A pick 48 is mounted to the picking actuator 46. When the picking actuator 46 is electrically activated, the pick 48 moves to the string 8, displaces the string 8, and glides over the string 8 in a rapid motion to create sound from the now vibrating string 8. The picking actuator 46 is mounted so movement of the pick 48 is generally perpendicular to the length of the string 8. In one embodiment as shown in FIG. 7, the picking actuator 46 is bidirectional in its electrically controllable motion and can pick the string 8 in back-and-forth motions of equal force. Varying the electrical force provided to the picking actuator 46 enables different picking forces and speeds for volume and sound variation of a plucked string 8. The picking actuator 46 is a two-coil bidirectional solenoid as shown in the embodiment in FIG. 7. In other embodiments, the picking actuator 46 can be a voice coil, a motor, a single solenoid, or two single coil solenoids positioned such that their magnetic pull forces are in opposition of each other as shown in FIG. 8. The picking actuator 46 may be rotary or linear. Picking motion is not solely limited to back-and-forth movements over the string 8 as shown in the embodiments displayed in FIG. 7 and FIG. 8. Picking motion can also be unidirectional or bidirectional where the picking motion resets to the same position after every picking action. To limit the mechanical noise created by the rapid acceleration and deceleration of the picking actuator 46 plunger or shaft, an embodiment using solenoids with no end stop exists as shown in FIG. 8. With no end stop, the plunger or shaft of the picking actuator will not create large mechanical vibrations upon hitting the end stop.

Figure 9:
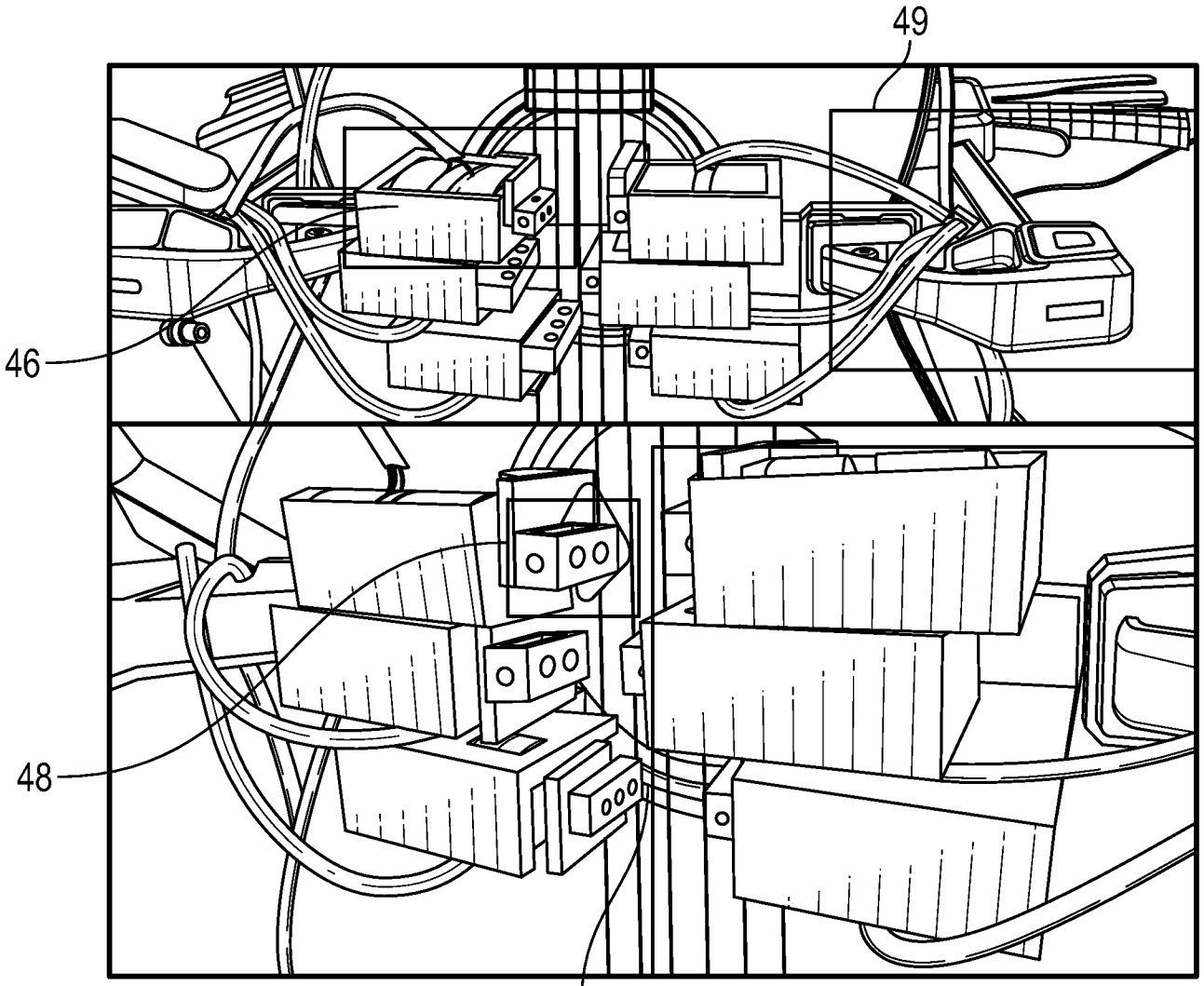
FIG. 9 shows the picking system for 6 strings on a 6-string acoustic guitar.

At least one picking grip 44 serves as a stationary point for the picking actuator 46 to be mounted to for each string 8. Depending on the instrument 2 and the number of strings 8 on the instrument 2, picking grips 44 can be mounted in pairs on either side of the strings 8 and/or exist as multiple separate pairs of picking grips 44. The picking grips 44 are releasably attached to the body 10 by a clamp 49 between the string-side of the body 10 and the non-string-side of the body 10 opposite to the string-side of the body 10. In one embodiment, the clamp 49 is a standard bar clamp as in FIG. 9. In other embodiments, fasteners serve as the clamp 49 and create a similar clamping force. The pressure formed by the clamping forces creates a strong releasably attached bond between the picking system 42 and the instrument 2. The picking system 42 can be removed from the instrument 2 by releasing the clamp 49. If the instrument 2 has paired strings 8 such as in a 12-string guitar, the picking system 42 will act on both strings 8 in the pair to pick/pluck in the same manner as described above.

The picking system 42 for each string 8 is calibratable for alignment to the string 8. The connection point between the pick 48 and picking actuator 46 and/or the connection point between the picking actuator 46 and the picking grip 44 may be manipulated with screws and captured threads to move the pick 48 and/or picking actuator 46 in two dimensions. The dimensions of calibration are perpendicular to the length of the string, 8 and generally perpendicular to the string-side of the body 10. Calibration is necessary to align the picking motion to pluck the desired string 8 cleanly and achieve optimal. The calibration of the picking system 42 enables the picking system to attach to many different styles of guitars and many other kinds of musical instruments 2 without having different versions of picking grip 44 components.

Figure 10:
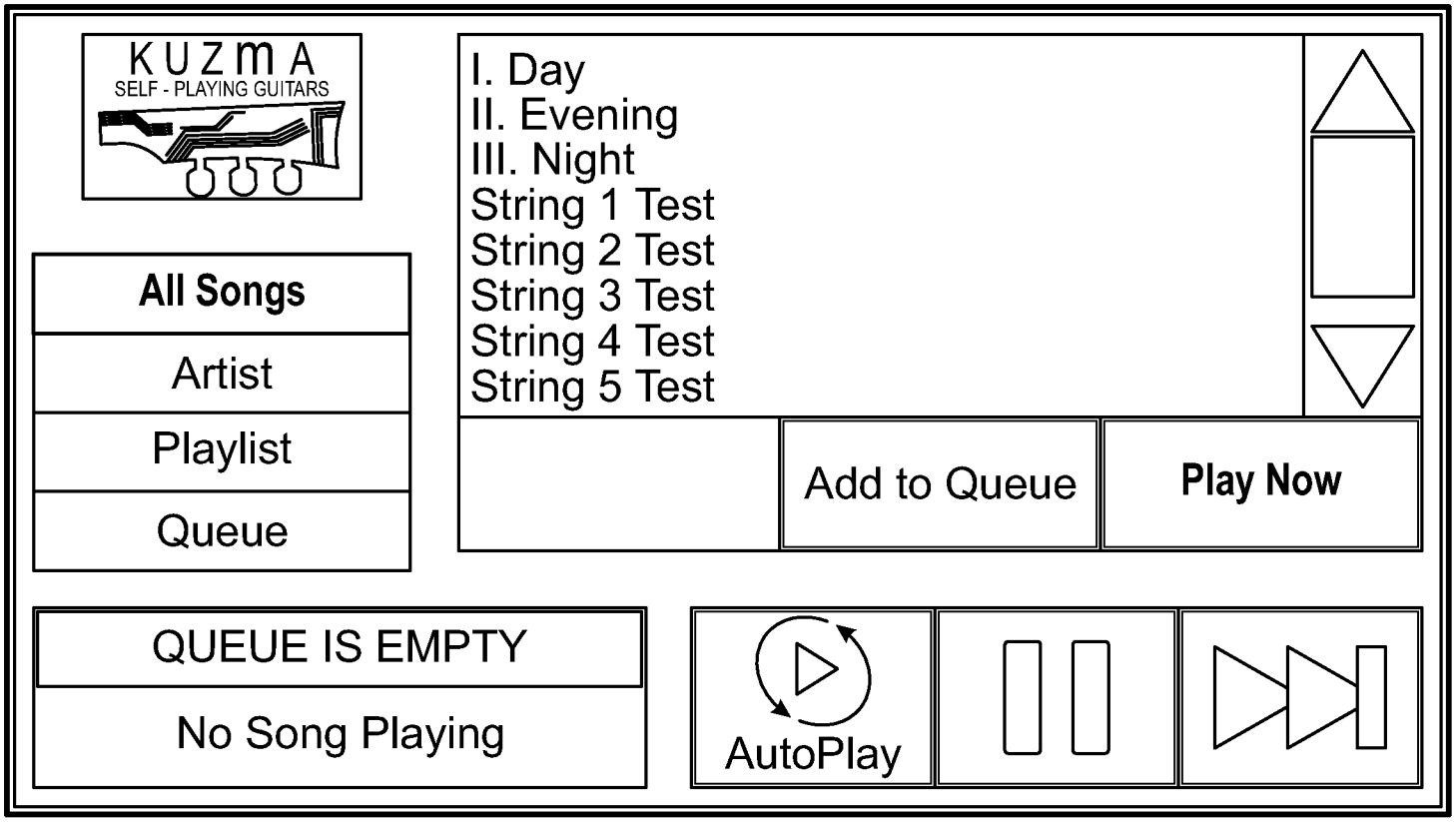

The interface 50 allows the user 58 of the invention to determine what music to play on the invention. An example of what the interface can look like is shown in FIG. 10. The interface 50 has features that can be seen on many music players. The features the user 58 has access to include but are not limited to play, pause, skip, shuffle, queue, repeat, auto-play, and search filters by artist, genre, time period, or playlist. These previously listed features can be applied to preprogrammed music stored on the interface 50. When the user 58 utilizes features of the interface 50 to play music, the interface 50 sends music data to a printed circuit board (PCB) 52. The PCB 52 will interpret the music data to gateway electrical power from a power supply 56 to the drive members 22, picking actuators 44, and fretting actuators 32 and play music on the instrument 2 through use of the picking system 42 and fretting system 14 on every string 8. In other embodiments, the user 58 can also input music data through the interface 50 by directly controlling what the invention plays in a real-time format. The interface 50 can be a touch screen attached near the instrument 2, a mobile application, and/or an external computer application. Software and music data of the Interface 50 and firmware of the PCB 52 can be updated through a wired or wireless connection from an external server or computer.

The invention claimed is:

1. An automated string player, comprising:

a stringed instrument with a neck, a fretting system that is attached to said stringed instrument, at least one fretting grip, and at least one fastener;

the said at least one fretting grip being fastened to said stringed instrument with said at least one fastener;

at least one rail and at least one drive member adapted to position an at least one fretting actuator to varied locations along said neck;

said at least one fretting actuator adapted to engage an at least one fretting hammer against a string of said stringed instrument to fret, press, or touch said string, change the musical pitch or tone of said string, and/or provide sound on contact of said string;

a picking system that is attached to said stringed instrument, at least one picking grip mounted to said stringed instrument, at least one picking actuator mounted to said at least one picking grip, said at least one picking actuator adapted to move at least one pick across said string of said stringed instrument to touch, pick, or pluck said string and achieve musical sound; and an at least one interface that enables user control of said fretting system and said picking system to play music; and said at least one picking actuator having a solenoid with no end stop to limit mechanical noise that would be produced by a shaft of the solenoid hitting an end stop.

2. The automated string player of claim 1, wherein said stringed instrument is not permanently manipulated or altered with the attachment of said fretting system, said picking system, and/or said interface.

3. The automated string player of claim 1, wherein said stringed instrument is a guitar or any stringed instrument with said neck and/or a fretboard/fingerboard.

4. The automated string player of claim 1, wherein an external computer is wired to or has a wireless connection with said interface and is adapted to update music data and provide software updates.

5. The automated string player of claim 1, wherein said interface is a touch screen attached to or near said stringed instrument, a mobile application, and/or an external computer application.

6. The automated string player of claim 1, wherein said automated string player performs guitar playing functions including picking, fretting, hammer-ons, tremolos, muting, harmonics, slides, bends, and pull-offs.

7. The automated string player of claim 1, wherein said fretting system and/or said picking system is repeated to play music on a plurality of additional strings of said stringed instrument.

8. The automated string player of claim 1, further comprising at least one sensor of optical, mechanical, and/or magnetic variety that is mounted to the said at least one fretting grip for a purpose of initialization of said fretting system.

9. An automated string player, comprising:

a stringed instrument with a neck, a fretting system that is attached to said stringed instrument, at least one fretting grip, and at least one fastener;

said at least one fretting grip being fastened to said stringed instrument with said at least one fastener;

at least one rail and at least one drive member adapted to position at least one fretting actuator to varied locations along said neck;

said at least one fretting actuator adapted to engage an at least one fretting hammer against a string of said stringed instrument to fret, press, or touch said string, change the musical pitch or tone of said string, and/or provide sound on contact of said string; and at least one sensor of optical, mechanical, and/or magnetic variety is mounted to the said at least one fretting grip for a purpose of initialization of said fretting system.

10. The automated string player of claim 9, wherein said at least one fretting grip is contacting said stringed instrument by means of a moldable material.

11. The automated string player of claim 9, wherein said at least one fretting grip has at least one tab contacting an edge of said neck to keep said fretting system level along a plane of a fretboard/fingerboard of said stringed instrument.

12. The automated string player of claim 9, wherein at least one magnet is mounted to said at least one fretting actuator, and a printed circuit board (PCB) determines a proximity of said at least one magnet with said at least one fretting grip for homing and/or initialization.

13. The automated string player of claim 9, wherein said at least one fretting actuator is singular or a plurality along said string.

14. The automated string player of claim 9, wherein said fretting hammer lowers to contact said string with an electrically controllable stroke or force.

15. The automated string player of claim 9, wherein a mounting point of said at least one rail to said at least one fretting grip is adjustable to align said fretting system to said string of said stringed instrument.

16. The automated string player of claim 9, wherein said fretting system is repeated to play music on a plurality of additional strings of said stringed instrument.

17. An automated string player, comprising:

a picking system that is attached to a stringed instrument;

at least one picking grip releasably mounted to said stringed instrument;

at least one picking actuator mounted to said at least one picking grip, said at least one picking actuator adapted to move at least one pick across a string of the stringed instrument to touch, pick, or pluck said string and achieve musical sound; and said at least one picking actuator having a solenoid with no end stop to limit mechanical noise that would be produced by a shaft of the solenoid hitting an end stop.

18. The automated string player of claim 17, wherein said at least one picking actuator is at least one of a bidirectional actuator, a rotary motor, and a single direction actuator with or without a return spring.

19. The automated string player of claim 17, wherein said at least one picking actuator movement being equal in either direction of motion across said string.

20. The automated string player of claim 17, wherein said at least one picking actuator is adapted to provide volume variation or sound variation by modifying electrical signals to said at least one picking actuator.

21. The automated string player of claim 17, wherein a position of said at least one picking actuator and/or said at least one pick is calibratable in relation to said string of said stringed instrument.

22. The automated string player of claim 17, wherein said picking system is repeated to play music on a plurality of additional strings of said stringed instrument.

* * * * *